US008381946B2

(12) United States Patent
Everson

(10) Patent No.: US 8,381,946 B2
(45) Date of Patent: Feb. 26, 2013

(54) CONTAINER HAVING A PRE-CURVED LID

(75) Inventor: Keith S. Everson, Hartford, WI (US)

(73) Assignee: Sussex IM, Inc., Sussex, WI (US)

( * ) Notice: Subject to any disclaimer, the term of this patent is extended or adjusted under 35 U.S.C. 154(b) by 97 days.

(21) Appl. No.: 12/963,469

(22) Filed: Dec. 8, 2010

(65) Prior Publication Data

US 2011/0315701 A1 Dec. 29, 2011

Related U.S. Application Data

(63) Continuation-in-part of application No. 12/822,688, filed on Jun. 24, 2010.

(51) Int. Cl.
*B65D 43/22* (2006.01)
*B65D 51/04* (2006.01)

(52) U.S. Cl. ..... 220/839; 220/837; 220/803

(58) Field of Classification Search ..... 220/839, 220/837, 836, 803, 802, 801, 797, 810, 657, 220/656, 796, 200; *B65D 43/22, 43/16, 51/04*
See application file for complete search history.

(56) References Cited

U.S. PATENT DOCUMENTS

| | | | | |
|---|---|---|---|---|
| 2,695,115 | A * | 11/1954 | Roop | 220/802 |
| 3,165,227 | A * | 1/1965 | Muoio et al. | 220/800 |
| 3,524,564 | A * | 8/1970 | Schurman | 220/324 |
| 3,817,420 | A * | 6/1974 | Heisler | 220/790 |
| 3,900,106 | A | 8/1975 | Cantales | |
| D241,820 | S | 10/1976 | Jewell | |
| 4,034,891 | A * | 7/1977 | Mecham | 220/835 |
| D278,412 | S | 4/1985 | Yeung | |
| 4,951,866 | A | 8/1990 | Rusnak | |
| 5,012,928 | A | 5/1991 | Proffitt et al. | |
| 5,131,551 | A | 7/1992 | Wells | |
| 5,204,130 | A | 4/1993 | McDevitt et al. | |
| 5,300,748 | A | 4/1994 | Colombo | |
| 5,474,199 | A | 12/1995 | Julius et al. | |
| 5,667,094 | A * | 9/1997 | Rapchak et al. | 220/834 |
| 5,699,925 | A * | 12/1997 | Petruzzi | 220/4.27 |
| 5,906,292 | A | 5/1999 | Rider, Jr. | |
| 5,920,916 | A | 7/1999 | Norton | |
| 5,938,068 | A | 8/1999 | Atkins et al. | |
| 5,960,987 | A | 10/1999 | Solland et al. | |
| 6,042,000 | A | 3/2000 | Kawamoto | |
| 6,102,231 | A | 8/2000 | Rider, Jr. et al. | |
| 6,164,488 | A | 12/2000 | Solland et al. | |
| 6,176,420 | B1 | 1/2001 | Sarson et al. | |
| 6,199,559 | B1 * | 3/2001 | Nikolaus et al. | 132/294 |

(Continued)

FOREIGN PATENT DOCUMENTS

| | | |
|---|---|---|
| WO | WO 89/03351 | 4/1989 |
| WO | WO 91/07329 | 5/1991 |

*Primary Examiner* — Jacob K Ackun
*Assistant Examiner* — Robert J Hicks
(74) *Attorney, Agent, or Firm* — Reinhart Boerner Van Deuren P.C.

(57) ABSTRACT

A plastic container having a container body and a permanently attached container lid is provided. The container lid is attached to the container body by a living hinge such that the entire plastic container is a one-piece construction. The container lid is pre-curved such that in an open state the container lid is curved. However, when the container lid mates with the container body in a closed state, at least a portion of the container lid that was previously curved becomes substantially planar such that portions of the lid remain biased into the container body. The container incorporates at least one projection that acts as a detent-catch mechanism to secure the lid to the body. The projection reduces the likelihood that the seal formed between the lid and the container when in a closed position will be inadvertently broken.

9 Claims, 16 Drawing Sheets

U.S. PATENT DOCUMENTS

D457,428 S 5/2002 Fowler et al.
6,409,034 B2 6/2002 Schorner
D473,137 S * 4/2003 Cadiente et al. ..... D9/423
6,554,147 B1 4/2003 Maida, Jr. et al.
6,592,504 B2 7/2003 Sarson et al.
6,609,623 B2 8/2003 Chou
D489,254 S 5/2004 Kocis et al.
6,758,390 B2 7/2004 Sarson et al.
D495,209 S 8/2004 Tranfaglia et al.
6,955,289 B2 10/2005 Green
6,962,263 B2 11/2005 Cadiente et al.
6,981,607 B2 1/2006 Lown et al.
7,017,776 B1 3/2006 Hupp
7,059,492 B2 * 6/2006 Giraud et al. ..... 220/834
7,073,680 B2 7/2006 Boback et al.
7,104,416 B2 9/2006 Gasco et al.
7,246,714 B2 7/2007 Garg et al.
D551,515 S 9/2007 Ablo et al.
7,284,673 B2 10/2007 Habeger et al.
D562,128 S 2/2008 van de Velde
7,398,892 B2 7/2008 Bouie
7,398,893 B2 7/2008 Bouie
D577,579 S 9/2008 Lymn et al.
7,419,067 B2 9/2008 Bouie et al.
D585,735 S 2/2009 Vovan et al.
D587,993 S 3/2009 Vovan
D591,148 S 4/2009 Parikh et al.
7,597,206 B2 10/2009 Atkins et al.
2003/0192888 A1 * 10/2003 Chang ..... 220/4.23
2004/0134910 A1 7/2004 Colombo
2004/0211823 A1 10/2004 Sarson et al.
2007/0012710 A1 1/2007 Vovan
2007/0045317 A1 3/2007 Rosender et al.
2009/0134180 A1 5/2009 Kidd et al.
2009/0223969 A1 9/2009 Bouie

* cited by examiner

CONTAINER HAVING A PRE-CURVED LID

CROSS-REFERENCE TO RELATED PATENT APPLICATIONS

This patent application is a continuation-in-part of co-pending U.S. patent application Ser. No. 12/822,688, filed Jun. 24, 2010, the entire teachings and disclosure of which are incorporated herein by reference thereto.

FIELD OF THE INVENTION

The present invention generally relates to reclosable containers and more particularly to reclosable containers having permanently attached lids and even more particularly to reclosable containers having lids attached to a container body by a living hinge.

BACKGROUND OF THE INVENTION

Many containers exist in the art for storing objects, such as around the home in the kitchen. The containers will typically have a removable lid such that the interior of the container can be repeatedly accessed, but then reclosed to maintain the contents within the container. However, containers that utilize fully removable lids suffer from the problem that the lid is often lost or is buried within a pile of different lids such that the appropriate lid cannot be located.

Further, many containers are formed from thin plastic materials. However, when thin plastic is formed, it will tend to shrink and warp after the molding process. This warping is typically uncontrolled such that mating surfaces of the container, such as at seals, will not adequately mate creating potential leak paths.

The present invention relates to improvements in the container art.

BRIEF SUMMARY OF THE INVENTION

In one embodiment, the present invention relates to a new and improved container including a container lid permanently attached to a container body by a living hinge. The container lid is pre-curved such that it has at least one defined curvature when in an open position and when in the closed position, this curvature becomes substantially planar. This transition from curved to planar allows for biasing various portions of the container lid into the container body. This biasing can maintain various portions of the container lid against the container body that in previous containers would have otherwise flared away from the container body.

In one particular embodiment, a plastic container including a container body, a container lid and a living hinge coupling the lid to the body is provided. The cup-shaped container body has a generally annular sidewall defining an open end. Opposite the open end is a container bottom. The container lid has a main body sized large enough to close the open end of the container body. An annular sealing flange extends from a bottom surface of the main body and into the annular sidewall in a closed position. The bottom surface of the main body includes a seat portion radially outward from the sealing flange. In the closed state, the bottom surface faces the container body. The living hinge couples the container lid and container body into a one-piece construction. The container lid pivots through the living hinge between an open position and the closed position via the living hinge. The seat portion includes a pair of side portions and a front portion. The pair of side portions being pre-curved in a convex manner in the open position and the front portion being pre-curved curved in a concave manner in the open position.

In a more particular embodiment, these pre-curved portions become substantially planar in a closed position.

In one embodiment, the sealing flange includes a pair of side portions adjacent the side portions of the seat portion, the side portions of the sealing flange bow radially outward. The side portions of the sealing flange extend between a rear portion of the sealing flange and a front portion of the sealing flange. The rear portion of the sealing flange is adjacent to the living hinge and the front portion of sealing flange is adjacent the front portion of the seat portion. A catch arrangement may be formed near the front portion of the seat portion in some embodiments.

In one embodiment, the pair of side portions of the sealing flange are biased radially outward and away from one another when the container lid is in the closed position. This biasing radially biases the pair of side portions into the annular sidewall of the container body to increase a radial seal therebetween. The sealing flange may be in the form of a plug seal.

In one embodiment, the height of the sealing flange from the bottom surface is substantially constant such that a free end, which is axially spaced away from the main body, of each side portion is convex in the open position and a free end, which is axially spaced away from the main body, of the front portion is concave.

In a further embodiment, the seat portion is substantially planar when the container lid is in the closed position. In a further embodiment, the container further includes a catch mechanism proximate the front portion of the seat portion. The catch mechanism engaging the container body to hold the container lid in the closed position and to oppose any forces generated by biasing the pre-curved lid into a planar shape.

In one embodiment, the seat portion includes a pair of corner portions. One corner portion is interposed between and transitions one of the side portion into the front portion. The other corner portion is interposed between and transitions the other side portion into the front portion. The seat portion is configured such that the corner portions contact the container body prior to the midpoint of the front portion as the container body transitions from the open position to the closed position such that the corner portions are axially biased into a top axial end of the annular sidewall. This promotes improved seating of the container lid relative to the container body.

In a further embodiment, the side portions of the seat portion contact the top axial end of the annular sidewall prior to the front portion as the container body transitions from the open position to the closed position such that the side portions are axially biased into the top axial end of the annular sidewall.

In one embodiment, the container lid further includes a reinforcing flange extending axially outward from the bottom surface of the main body. The reinforcing flange is spaced radially outward from the sealing flange. The reinforcing flange, sealing flange and seat portion define a channel that receives at least a portion of three sides of the container body when the container lid is in the closed position. This channel faces away from the bottom surface of the container lid. In one embodiment, the reinforcing flange and sealing flange have a corresponding pre-curved shape as the adjacent portions of the seat portion in the open position.

In one embodiment, the seat portion is substantially planar in the closed position.

In a further embodiment, the seat portion includes a pair of rear corner portions. One corner portion is interposed between and transitions one of the side portions into a rear portion of the seat portion. The other corner portion is interposed between and transitions the other side portion into the rear portion. The seat portion being configured such that the rear corner portions contact the container body prior to the midpoint of the front portion as the container body transitions from the open position to the closed position such that the rear corner portions are axially biased into a top axial end of the annular sidewall.

In one embodiment, the catch arrangement for securing the container lid in a closed position is provided by a radially inward extending catch or rib formed by the container lid and a radially outward extending top flange formed by the top end of the annular sidewall of the container body.

In one embodiment, the reinforcing flange and the sealing flange extend axially from the bottom surface a same height.

In a further embodiment, a further plastic container including a container body, a container lid, a living hinge and a catch arrangement is provided. The container body has a bottom and a generally annular sidewall extending from the bottom. The annular sidewall defines an open end. The container lid has a main body sized large enough to close the open end of the container body. The living hinge couples the container lid and container body into a one-piece construction. The container lid pivots through the living hinge between an open position and a closed position. The catch arrangement secures the container lid in the closed position. The main body is configured such that a pair of spaced apart front corner portions of the main body abut a top end of the annular sidewall prior to a front middle portion of the main body interposed between the pair of front corner portions as the container lid is transitioned to the closed position.

In a further embodiment, the catch arrangement is adjacent the middle portion of the main body.

Further yet, in one embodiment, the main body includes a pair of side portions extending rearward relative to the corner portions and the front middle portion toward the living hinge. The main body is configured such that the side portions abut the top end of the annular sidewall prior to the front middle portion or the pair of front corner portions.

In one embodiment, the top end of the annular sidewall is substantially planar and the portion of the main body adjacent the top end is substantially planar when the container lid is in the closed position due to the main body being axially biased into the top end of the annular sidewall.

In another embodiment, a plastic container having increased seal integrity is provided. A plastic container according to this embodiment includes a generally cup shaped container body. The cup shaped container body has a bottom and a sidewall depending upwardly from the bottom. The bottom and the sidewall define a storage area. The container body also includes a flange formed on the sidewall. The flange extends radially outward from the sidewall. A lid is coupled to the container body by a living hinge. The lid is adapted to rotate about the living hinge between an open and closed position. The lid includes a sealing flange and a skirt each of which depends downwardly from a bottom surface of the lid. A receiving channel is formed between the sealing flange and the skirt. A projection is formed on the container lid. The projection resiliently engages the flange between the open and the closed positions. The flange and the projection are disposed within the receiving channel when the lid is in the closed position.

In another embodiment, the projection is disposed below the flange in the closed position within the receiving channel. In another embodiment, the projection extends radially inward from an inner surface of the skirt and into the receiving channel. The skirt is adapted to resiliently deflect radially away from the flange upon engagement of the flange by the projection. In another embodiment, there is a clearance gap between the projection and the flange when the lid is in the closed position.

In yet another embodiment, the projection comprises a plurality of detents. The plurality of detents extend radially inward from the inner surface of the skirt. In another embodiment, the plurality of detents are symmetrically arranged about a center axis of the container lid in an opposed spaced relation.

In another embodiment, the skirt has a front wall and a pair of sidewalls extending away from the front wall. The inner surface extends along the front wall and sidewalls. The plurality of detents are formed on the sidewalls.

In another embodiment, the detents are positioned on one sidewall are aligned with the detents positioned on the opposed sidewall. In another embodiment, each one of the plurality of detents is movable relative to the flange independently of each other one of the plurality of detents. In another embodiment, each one of the plurality of detents is generally dome shaped.

In another embodiment, a plastic container having a lid that can be positioned in various configurations is provided. A plastic container according to this embodiment includes a lid having a plurality of detents formed thereon in an opposed spaced relation. The container also includes a container body having a bottom and a sidewall with a flange formed at an end of the sidewall. The lid and container body are connected by a living hinge. Each one of the plurality of detents are moveable relative to the flange independently of each other one of the plurality of detents.

In another embodiment, the lid has an open position relative to the container body. In the open position, all of the plurality of detents are above the flange. In another embodiment, the lid has an intermediate position. In the intermediate position, at least one of the plurality of detents is positioned below the flange, and at least one other one of the plurality of detents is positioned above the flange. In another embodiment, the lid has a closed position. In the closed position, all of the plurality of detents are positioned below the flange.

In another embodiment, the plurality of detents are formed on an inner surface of a skirt, the skirt adapted to resiliently deflect away from the flange to position any one of the plurality of detents below the flange. In another embodiment, the plurality of detents are symmetrically arranged along the skirt relative to a center axis of the lid. In another embodiment, the skirt depends downwardly from a bottom surface of the lid and includes a front wall and a pair of sidewalls extending rearwardly therefrom. The plurality of detents are regularly spaced along the pair of sidewalls.

In another embodiment, each one of the plurality of detents extends radially inward from the inner surface of the skirt and into a receiving channel formed between the skirt and a ceiling flange depending downwardly from the bottom surface of the lid.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
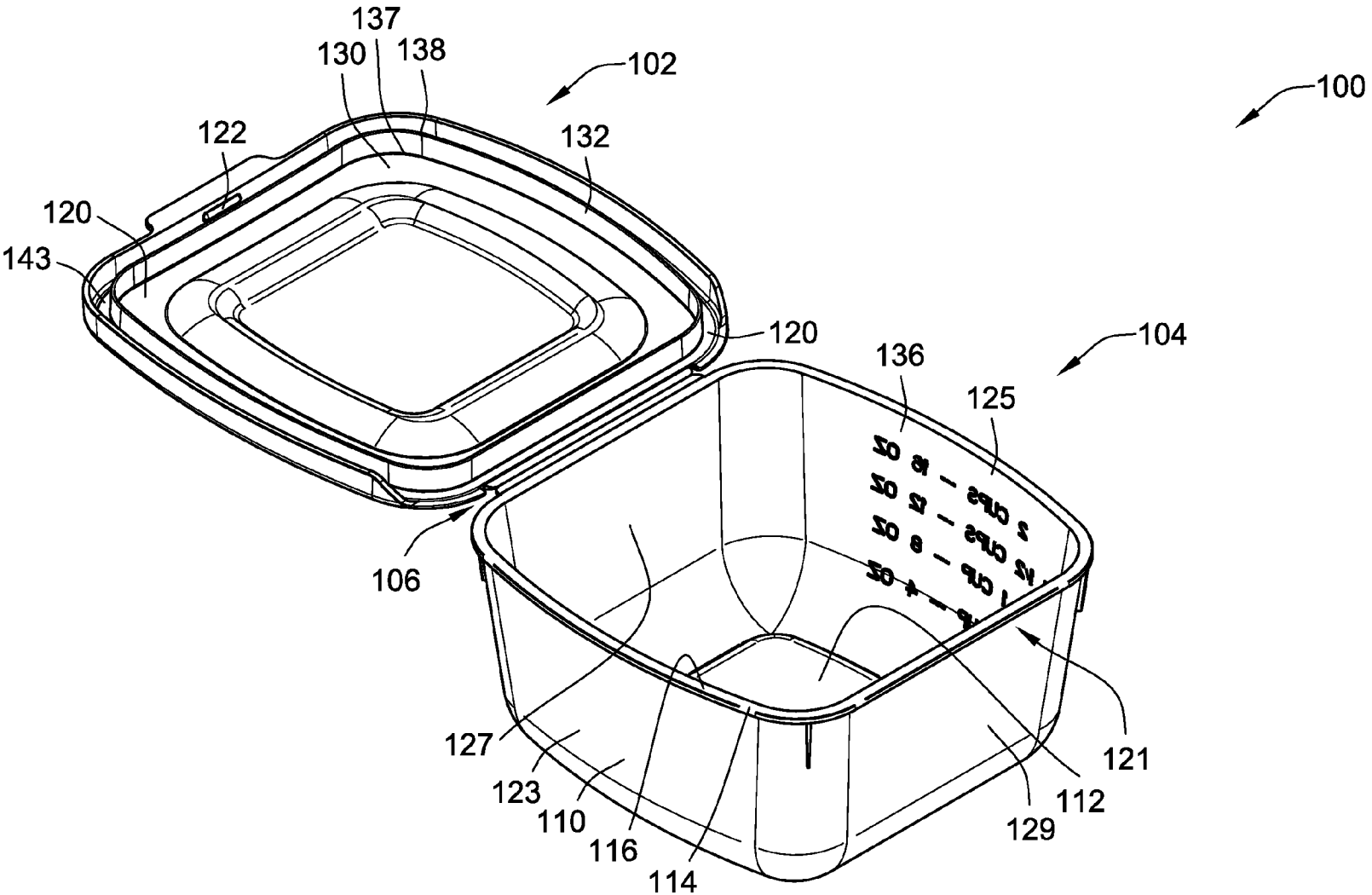
FIG. 1 is a top perspective illustration of a container according to an embodiment of the present invention.

FIG. 1 is a perspective illustration of a representative embodiment of a container 100 according to one embodiment of the present invention. The container 100 is generally used to store household objects, for example, food objects or other objects. However, it will be recognized from the following that embodiments of the invention described herein may be utilized in containers in commercial settings. Further, it will also be recognized that the aspects of the invention described relative to the disclosed embodiments may be extended to containers of various sizes and shapes, and are not limited to the particular size or shape of the containers illustrated and described herein.

The container 100 generally includes a container lid 102 and a container body 104. The container lid 102 is formed with the container body 104 as a one-piece construction and is not formed as a plurality of parts separately attached together.

Figure 2:
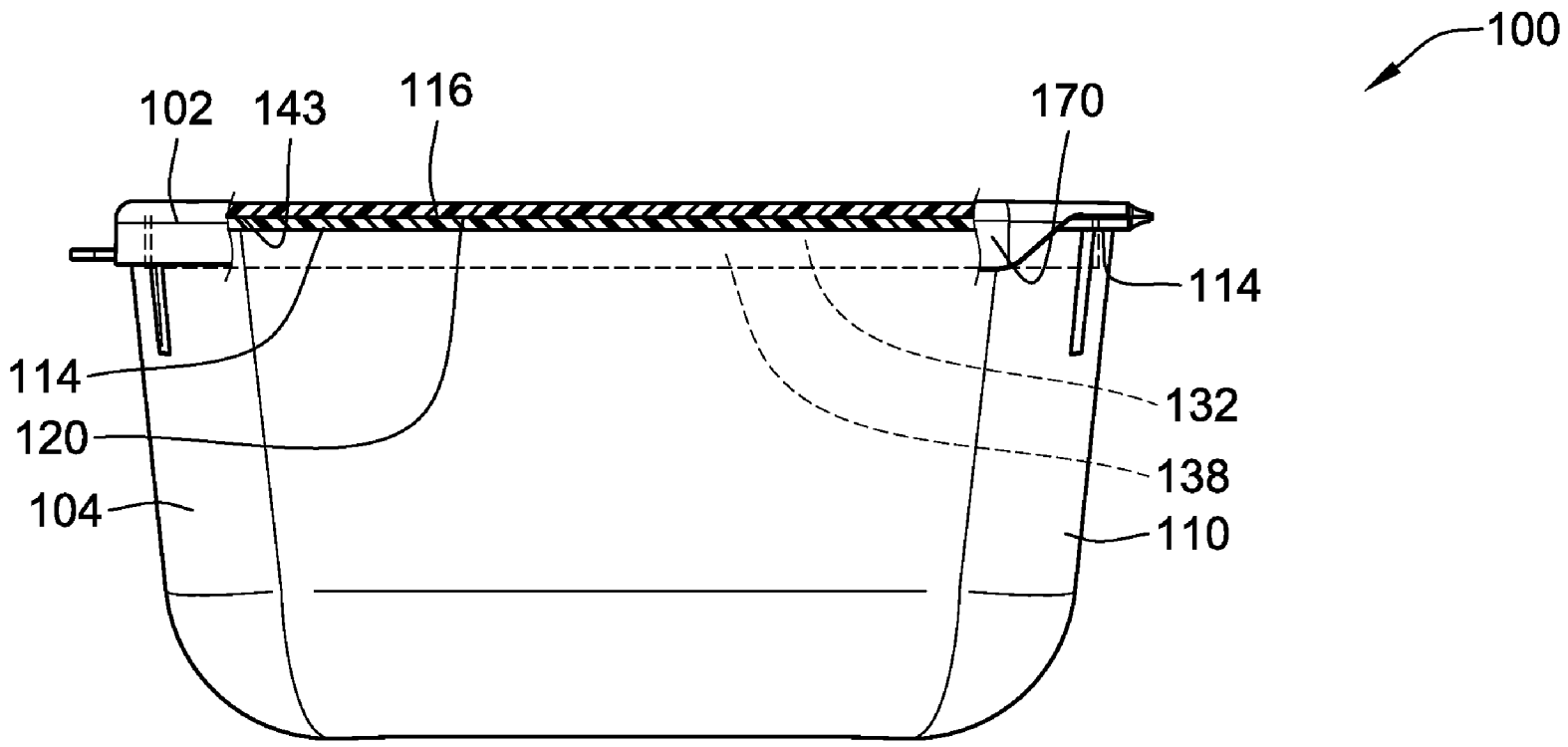
FIG. 2 is a partial side view illustration of a the container of FIG. 1 in a closed orientation.

A living hinge 106 attaches the container lid 102 to the container body 104. The living hinge 106 allows the container lid 102 to pivot relative to the container body 104 between open and closed positions while permanently securing the lid 102 to the container body 104. In the open position (FIG. 1), contents stored within the container 100 can be accessed. In a preferred embodiment, the container lid 102 seals relative to the container body 104 in the closed position (FIG. 2).

Further, the living hinge 106 permanently attaches the container lid 102 to the container body 104 such that the container lid 102 cannot be lost or displaced from the container body 104. This prevents the recurring problem of losing the lid 102 in a closet or cabinet, as often occurs with lids that are not permanently attached to the container body 104.

The container body 104 generally includes a cup shaped body portion that generally includes a generally annular sidewall portion 110 that extends upward from a bottom portion 112 forming the cup-shaped body portion. The cup shaped body portion is the portion that generally holds the products stored within container 100. The annular sidewall portion 110 and bottom portion 112 are formed into a one piece construction with the container lid 102, typically by injection molding. As such, the entire container 100 is a single piece of material and not a plurality of pieces separately snapped together or otherwise secured to one another. The full container 100 is preferably formed from a clarified polypropylene.

Figure 3:
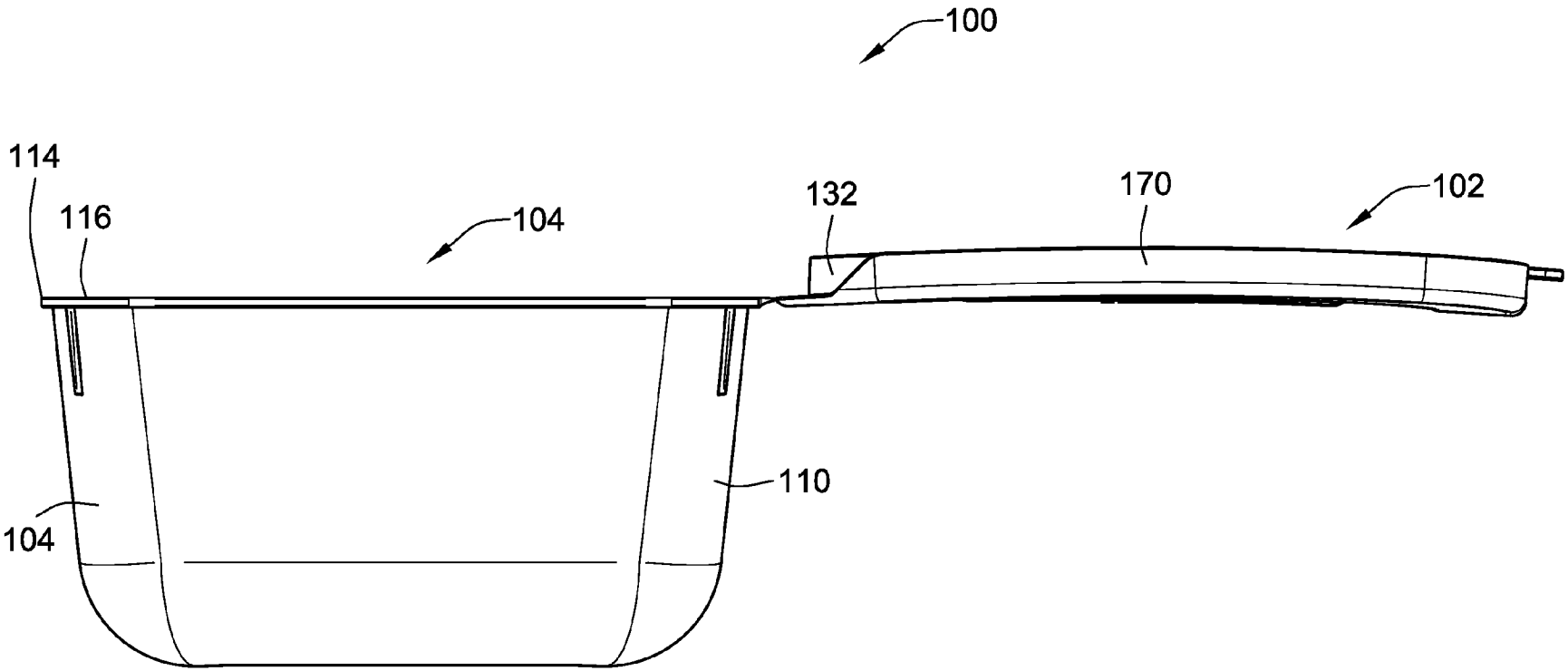
FIG. 3 is a side view illustration of the container of FIG. 1 in an open orientation.
Figure 4:
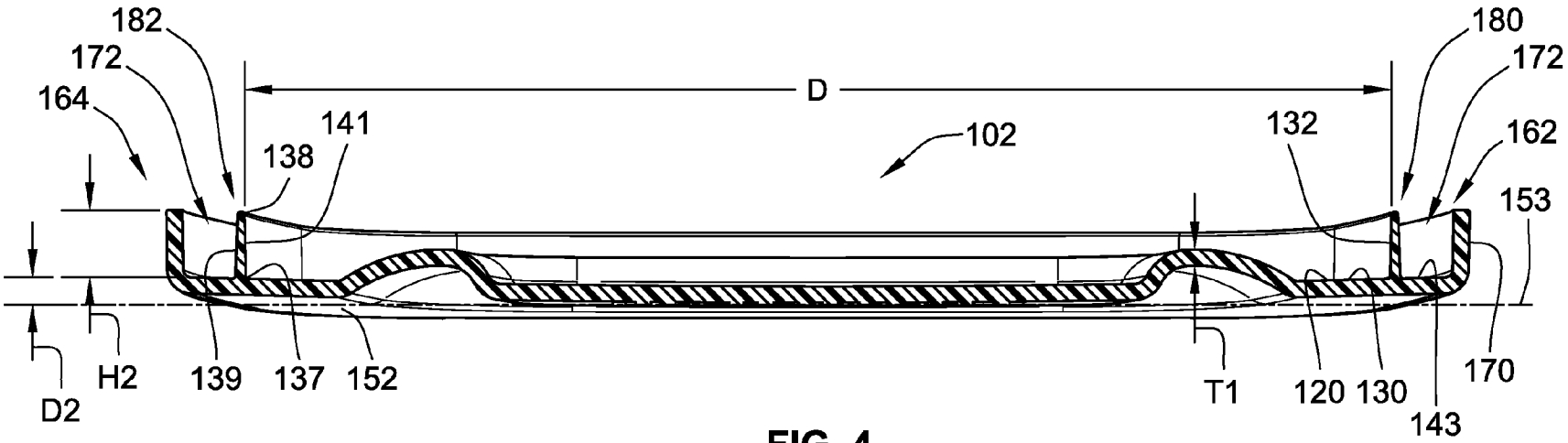
FIG. 4 is a cross-sectional illustration of the container lid of the container of FIG. 1 taken about line 4-4 of FIG. 12.

With reference to FIGS. 1 and 3, the container body 104 includes a radially extending top flange 114 that has a top surface 116 upon which a bottom surface 120 of the container lid 102 seats when the container lid 102 is in the closed position. The radially extending top flange 114 defines a region 121 that interacts with a catch arrangement, illustrated as a radially inward extending latch segment 122, for securing the container lid 102 in the closed position. In a preferred embodiment, the top surface 116 of flange 114 is planar when the container 100 is in both the open and closed positions.

While the cross-section of the annular sidewall portion 110 is generally rectangular, the opposed lateral sides 123, 125 that extend between the rear and front sides 127, 129 are generally bowed radially outward. However, other designs could use generally straight sides. Adjacent ones of the sides are connected by a radius corner. In preferred embodiments, the top flange 114 extends outward beyond the outer surface of the adjacent sides 123, 125, 127, 129 by between about 0.050 and 0.070 inches and preferably between about 0.055 and 0.065 inches.

Further, the sides 123, 125, 127, 129 taper outward from each other when moving away from the bottom portion 112. This taper is typically between about 91 degrees and 100 degrees and most typically between about 94 degrees and 98 degrees. The outer surfaces of the radiused corners between adjacent sides 123, 125, 127, 129 include abutments formed therein that abut the top surface 116 of a second container body 104 when a plurality of containers are stacked together. This prevents the stacked container bodies from locking together.

The container lid 102 includes a main body 130 that covers the open end of annular sidewall 110 to close the container 100. The main body 130 provides bottom surface 120 that seats against top surface 116 of the top flange 114. In some embodiments, the container lid 102 is maintained axially compressed against top flange 114 such that an axial seal is provided between top surface 116 and bottom surface 120.

The container 100 further includes a sealing flange 132. The sealing flange 132 may be considered part of the container lid 102. The sealing flange 132 extends axially from the main body 130 and more particularly from bottom surface 120 of main body 130.

The sealing flange 132 forms a radial seal with inner surface 136 of annular sidewall 110. As such, the sealing flange 132 is generally annular in shape as well.

The sealing flange 132 is preferably wedge shaped such that it has a wider base portion 137 proximate main body 130 and a narrower distal tip portion 138 spaced axially away from main body 130. The radially outer surface 140 of the sealing flange 132 is preferably canted relative to bottom surface 120 at an angle of between about ninety (90) degrees and one-hundred (100) degrees. More preferably, the angle is between about ninety-two (92) and ninety-five (95). This canted relationship allows for easier insertion of the sealing flange 132 into annular sidewall 110 during closing operations of the container lid 102.

The inner surface 141 is preferably canted relative to bottom surface 120 at an angle of between about ninety (90) degrees and one-hundred (100) degrees. More preferably, the angle is between about ninety (90) and ninety-three (93) and is preferably about ninety-one (91) degrees.

The sealing flange 132 preferably has a width of between about 0.030 and 0.045 at the base portion 137 (measured parallel to bottom surface 120 of main body 130) and a width of between about 0.020 inches and 0.030 inches at the distal tip portion 138. In a preferred embodiment, the height H1 of the sealing flange 132 is substantially constant the entire circumference of the annular sealing flange 132, i.e. along all for sides of the container lid 102. Preferably, height H1 is between about 0.225 inches and 0.325 inches and more preferably between about 0.250 inches and about 0.285 inches.

The wall thickness T1 of the main body portion is preferably between about 0.058 and 0.070 inches and more preferably between about 0.060 and 0.067 inches.

The container lid 102 also includes a reinforcing skirt 170. The reinforcing skirt 170 extends axially away from the main body 130 and is in generally constant spaced relation radially outward from the sealing flange 132. The reinforcing skirt 170 extends along at least part of three sides of the container lid 102. The reinforcing skirt 170 increases the rigidity of the container lid 102. In the closed position, the reinforcing skirt 170 is radially outward of the top flange 114 of the container body 104 and depends downward overlapping a portion of the adjacent sides of the container body 104.

The sealing flange 132 and reinforcing skirt 170 form a receiving channel 172 therebetween. The receiving channel 172 axially receives the top end of the annular sidewall 110 of the container body 104. More particularly, it receives a portion of the top flange 114 of sides 123, 125 and 129 of the container body 104, when the container 100 is in the closed position.

The catch segment 122 is formed as a nib extending radially inward from an inner surface of the reinforcing skirt 160 (see FIG. 1).

The main body 130 includes a seat portion 143 that is radially between the sealing flange 132 and reinforcing skirt 170. The seat portion 143 forms the bottom of receiving channel 172. The shape and configuration of this portion of the main body is configured to promote improved sealing of the container lid 102 to the container body 104 as will be further described below.

The container lid 102 is designed to provide an improved seal and seat with the container body 104. The applicants of the present application have determined that problems occur when securing a container lid to a container body using clasps or catch arrangements such as that of the instant invention. When the clasp or catch arrangement is in the middle of a side, the corners of the lid will tend to lift away from the container body creating a leak path. Further, in some embodiments, when the catch or clasps are only on the front side of the lid (i.e. the side opposite the living hinge), the lid may bow axially away from the lateral sides extending between the front and rear sides such that the container lid does not seat well on the top surface of those lateral sides. The present invention has been configured to improve the seal and seat between the container lid 102 and container body 104, such that in one embodiment a water tight seal is provided, as will now be explained. As used herein, a water tight seal is provided when the container can be filled with water, turned upside down, and placed resting on the container lid 102 and the container 100 does not leak water.

The main body 130 of the present invention is pre-curved when the container lid 102 is in the open position. However, when the container lid 102 is in the closed position, the main body 130 is substantially planar. The particular portion of the main body that transitions from this pre-curved arrangement to a substantially planar arrangement is the portion of the main body adjacent the sealing flange 132 and at least the seat portion 143 of the main body 130 that is radially outward of the sealing flange 132 that is axially biased against the top surface 114 of the container body 104 in the closed position. It should be noted that some deviation is permitted from being perfectly planar, however, in the closed position, this seat portion 143 will be, at least, more planar than it was in the open position.

Thus, as the container lid 102 transitions from being fully open (see FIGS. 1 and 3) to a fully closed position (see FIG. 2), the container lid 102, and particularly the relevant portions thereof, can be seen as "unrolling" to a more planar arrangement.

Figure 12:
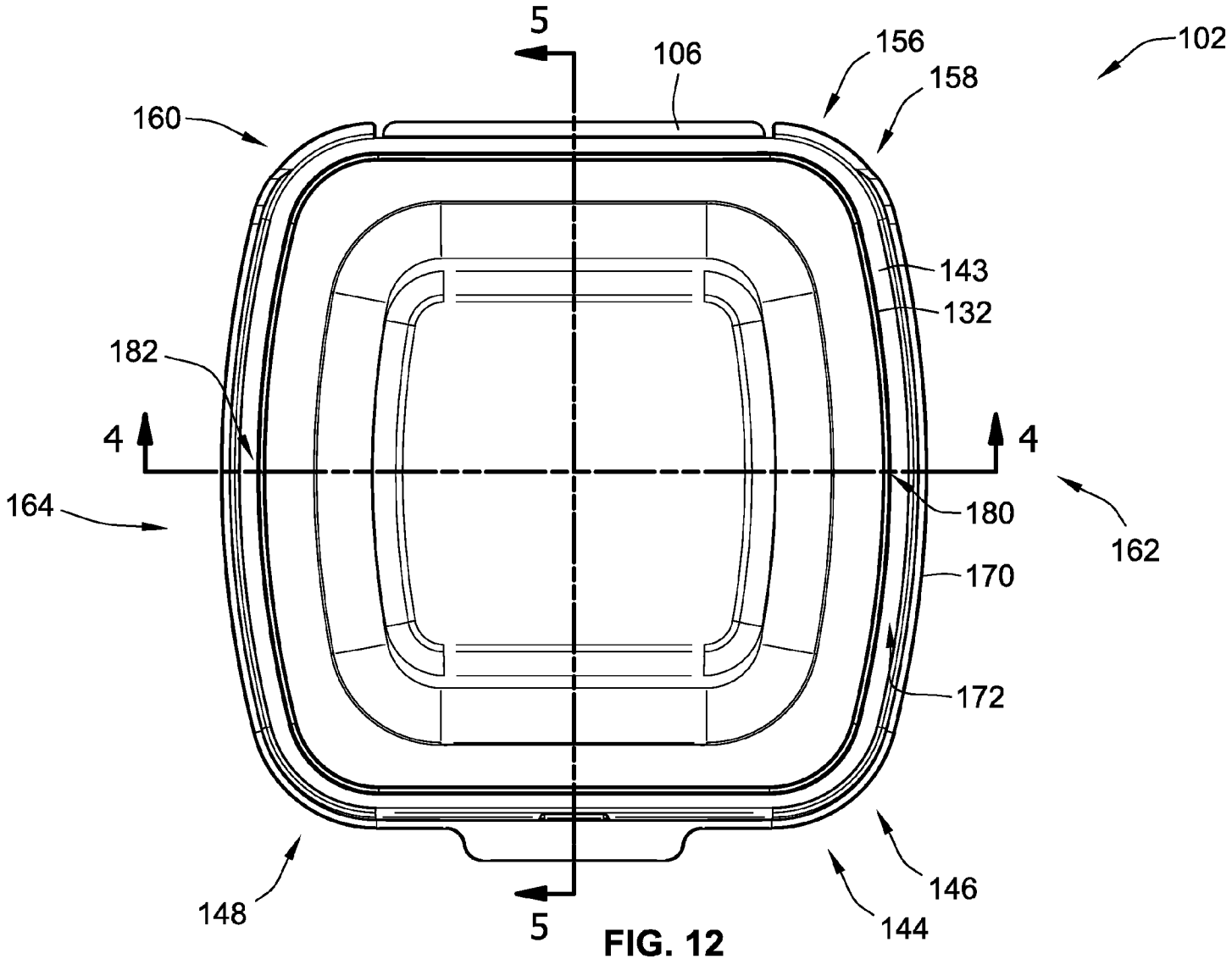
FIG. 12 is a bottom illustration of the container lid of FIG. 1.

The pre-curvature of the front portion 144 will be described with reference to FIGS. 4-8. Because the reinforcing skirt 170 has a constant height H2 (see FIG. 4) from seat portion 143, the curvature of distal end of the reinforcing skirt 170 will follow the curvature of seat portion 143. Further, the curvature of seat portion 143 can be seen when comparing the various distances D2 of the seat portion from reference plane 153. Reference plane 153 is defined by a plane that is parallel to living hinge 106 but that passes through the intersection of the base portions 137 of the sealing flange 132 and the seat portion 143. Further, the plane includes the two points at the midpoint of the front portion 144 of the seat portion 143 and the rear portion of the seat portion 143. Both of these points would be on line 5-5 in FIG. 12.

Figure 7:
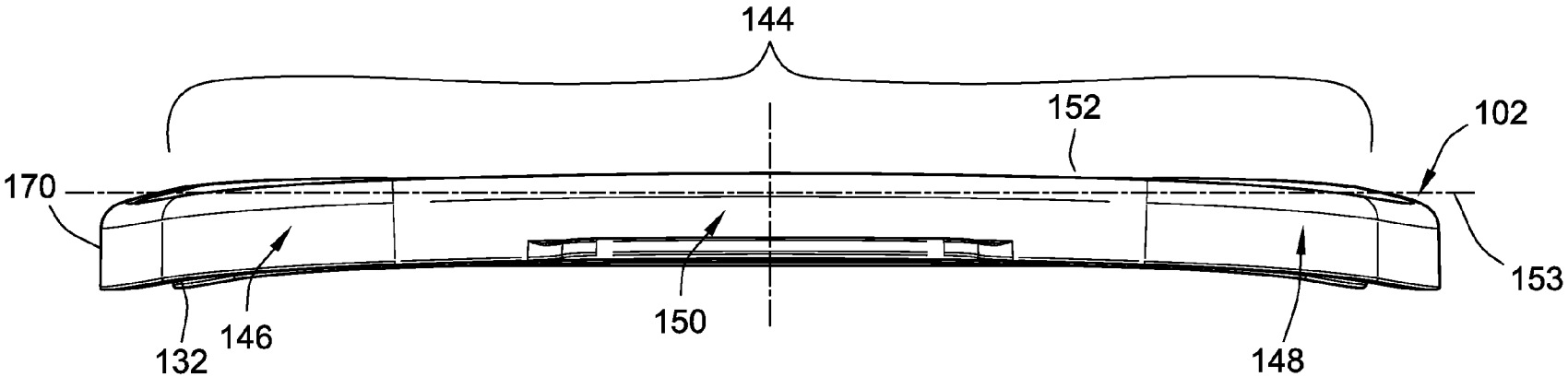
FIG. 7 is a front view illustration of the container lid of FIG. 1.

The seat portion 143 is pre-curved in two separate directions. A front portion 144 of the main body 130 is curved such that the corner portions 146, 148 are vertically upward relative to the center portion 150 thereof proximate the catch 122. Vertically upward is a relative term used based on the orientation in FIGS. 1 and 2 with the container lid 102 in an open position. In FIG. 7, the illustration of corners 146, 148 is downward, however, the lid 102 is illustrated in a closed orientation relative to FIGS. 1 and 2. But, as can be seen in FIG. 7, the front of the container lid 102 varies relative to reference plane 153 when traveling from side to side of the container lid 102.

In this arrangement, seat portion 143 of bottom surface 120 is generally concave when extending laterally from side to side from one corner portion 146 to the other corner portion 148. This concave profile causes the two corner portions 146, 148 to be biased into the corresponding corner locations of the top surface 116 of the container body 104 when the container lid 102 is in the closed position relative to the container body 104. The catch 122 of the container lid 102 provides the force biasing the curved portions of the container lid 102 into the top surface 116.

Figure 5:
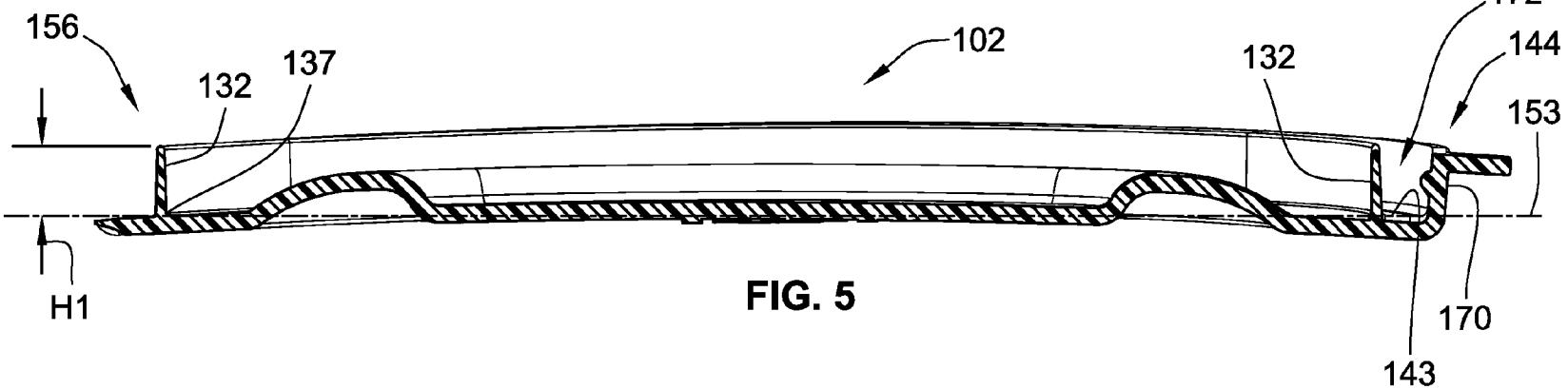
FIG. 5 is a cross-sectional illustration of the container lid of the container of FIG. 1 taken about line 5-5 of FIG. 12.
Figure 6:
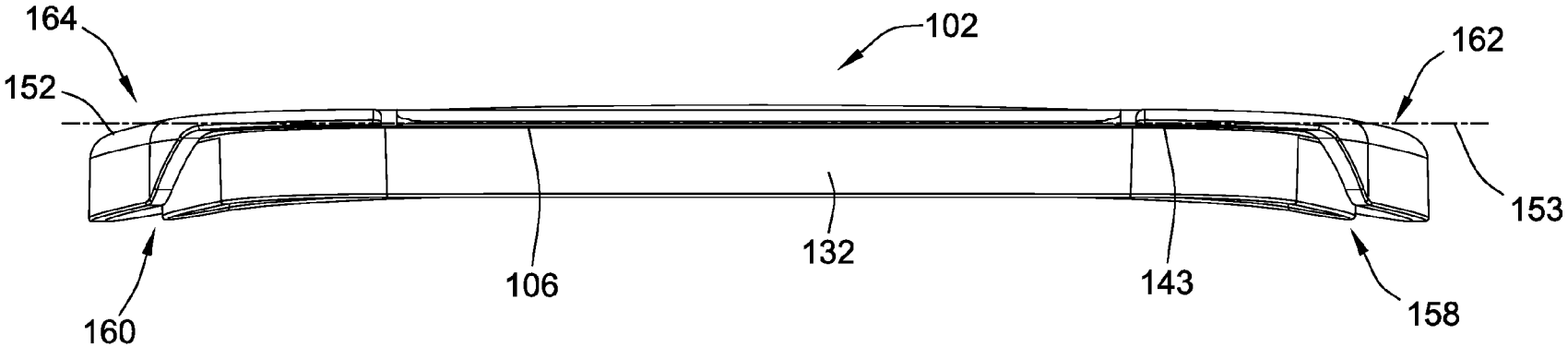
FIG. 6 is a rear view illustration of the container lid of FIG. 1.

This curved profile can also be seen by FIG. 5, wherein a top surface 152 of the main body 130 is visible from a side profile view (see FIG. 8) of the container lid 102.

In this configuration, when the catch 122 snap engages radially extending top flange 114 to secure the container lid 102 in the closed position, the center portion 150 of the main body 130 is drawn down onto the top surface 116 of the container body 104 after the corner portions 146, 148 contact top surface 116. This biases the corner portions 146, 148 into the top surface 116 causing the corner portions 146, 148 to flex relative to center portion 150 such that the seat portion 143 of the front portion 144 becomes more planar.

The seat portion 143 of a rear portion 156 of the container lid has a similar concave profile, but to a lesser extent. The portion of the seat portion 143 directly adjacent the living hinge 106 is substantially straight. Only corner portions 158, 160 are curved providing the concave shape.

Figure 8:
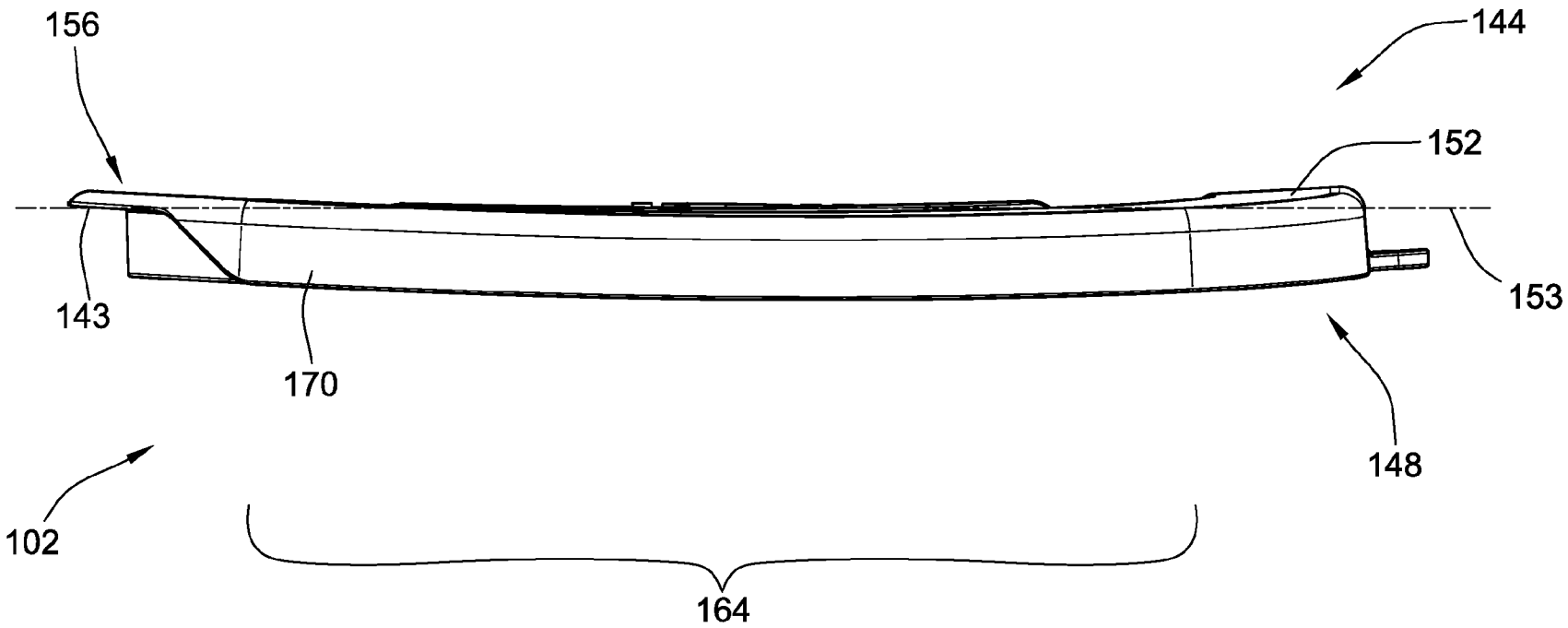
FIG. 8 is a side view illustration of the container lid of FIG. 1.

With particular reference to FIG. 8, not only are the front and rear portions 144, 156 of the container lid 102 curved extending from lateral side to lateral side, the container lid 102 and more particularly main body 130 is pre-curved in the open position from the rear portion 156 (i.e. proximate rear corners 158, 160 and living hinge 106) to the front portion 144 (i.e. proximate front corners 146, 148). This curvature is convex, i.e. opposite of the curvature from one side to side. More particularly, when transitioning from the one front corner 146, 148 to a rear corner 158, 160 on the same lateral side, the top surface 152 is generally concave and the bottom surface formed by seat portion 143 is generally convex. Again, this concavity is at least present on the portion of the top surface that is radially outward from sealing flange 132.

Figure 9:
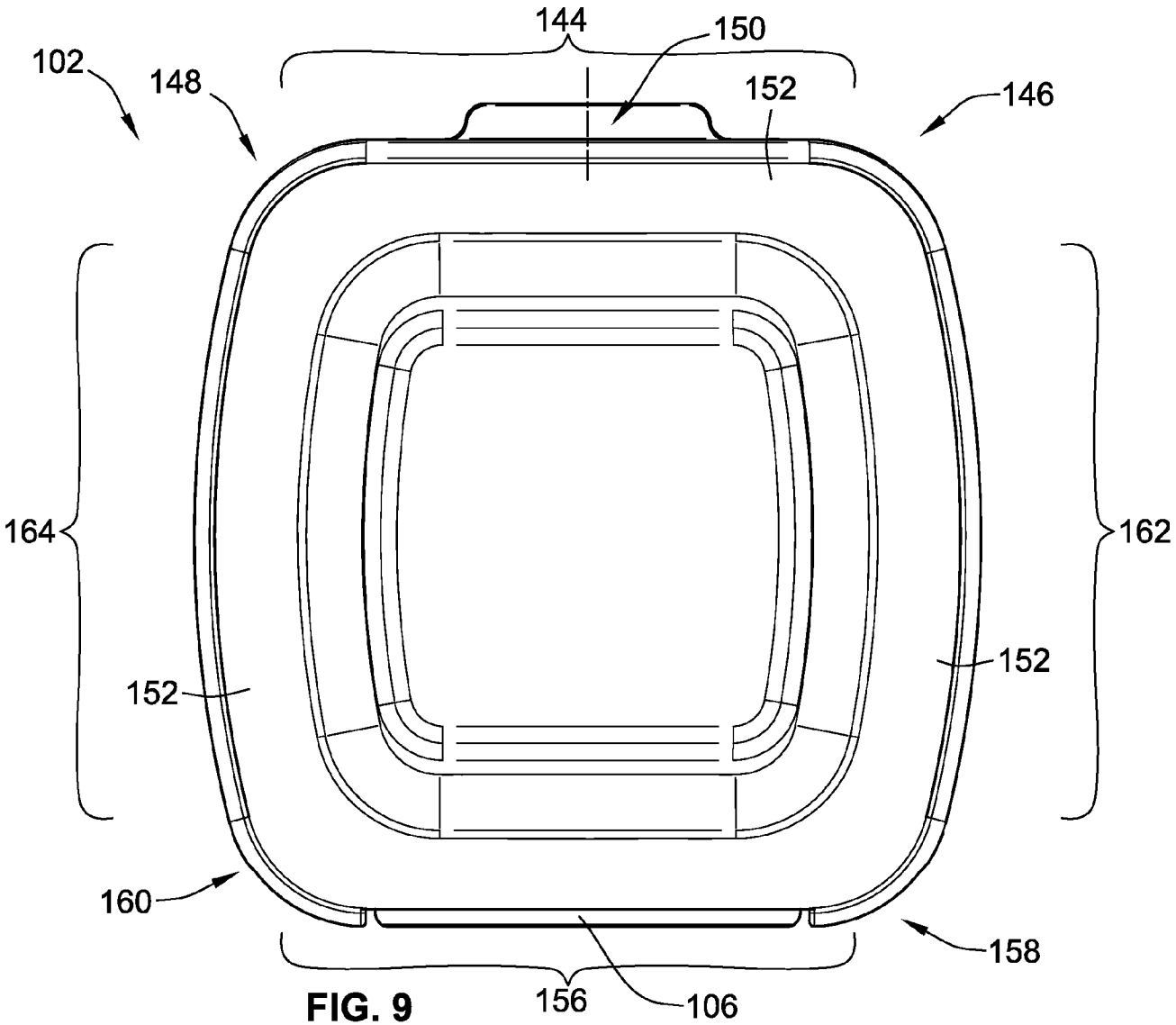
FIG. 9 is a top illustration of the container lid of FIG. 1.
Figure 11:
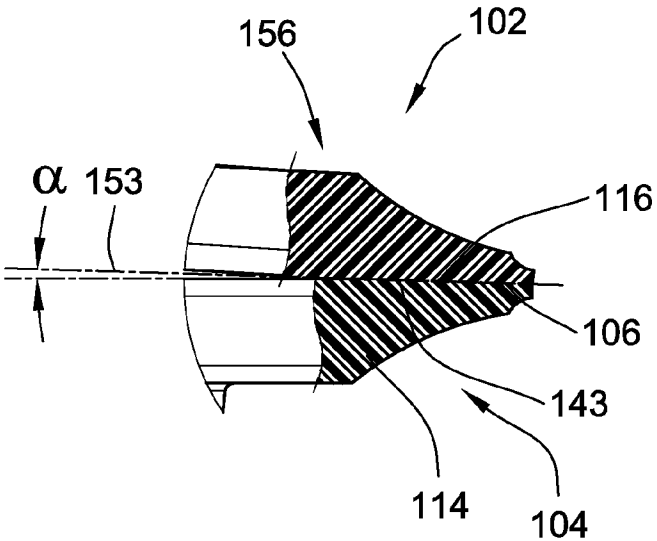
FIG. 11 is a partial enlarged cross-sectional illustration of the beginning of the seating of the container lid to the container body.

This curvature assists in maintaining the middle of lateral side portions 162, 164 (see FIG. 9) of the container lid 102 and more particularly the main body 130 axially seated against top surface 116 in the closed position.

As the container lid 102 closes relative to the container body 104, the middle of lateral side portions 162, 164 will seat onto the top surface 116 prior to corner portions 144, 146. Consequently, the middle portion of the lateral sides portion 162, 164 will contact top surface 116 prior to the catch 122 engages radially extending top flange 114. When the container lid 102 closes, it can almost be viewed as if the container lid 102 is "un-rolling."

Figure 10:
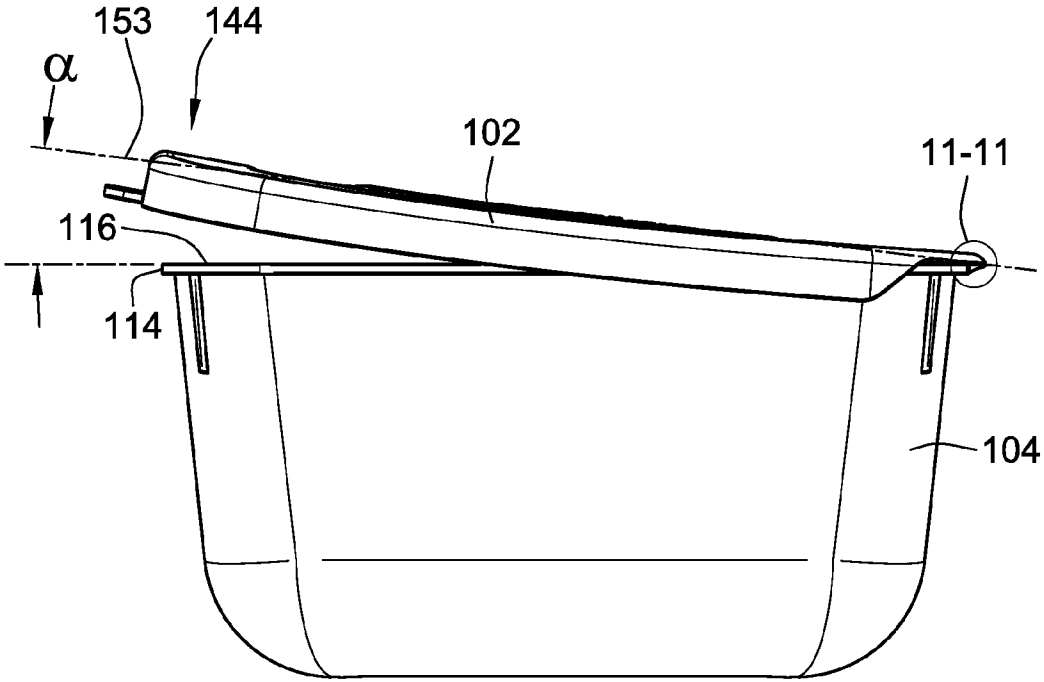
FIG. 10 is a side view illustration of the container lid of the container of FIG. 1 in a partially open orientation, with the container lid rotated such that it begins to seat on a top surface of the container body of the container.

FIG. 10 illustrate the container lid in an open state right as it begins to close. FIG. 10 illustrates when the seat portion 143 has begun to rest on the top surface 116 of top flange 114 proximate living hinge 106. As the container lid 102 closes relative to container body 104, the rear portions of the container lid 102 and container body 104 will contact first. This is illustrated in FIG. 10 as the front portion 144 of the container lid 102 is lifted off of top surface 116 of top flange 114 while the rear portion 156 of the container lid 102 is pressed axially into top surface 116. In one embodiment, the container lid 102 will be open at an angle $\alpha$ of between about 5 and 20 degrees when the rear portion of the seat portion 143 adjacent living hinge 106 is seated against top surface 116. This angle $\alpha$ is defined between the top surface 116 of the top flange 114 and an theoretical plane 153 defined by the intersection of the base 137 of the sealing flange 132 adjacent the living hinge and the center point 150 of the front portion 144 at the base 137 of the sealing flange 132.

It can be seen that the combination of curves formed into the container lid 102 will promote improved seating of the seat portion 143 of bottom surface 120 onto top surface 116 at all locations and particularly those locations that are not directly adjacent to one or more catches 122.

For completeness, other embodiments may use latches at different locations such as at the corners (i.e. corners 146, 148 rather than the middle portion 150. In this instance, the front curvature would be the opposite such that the middle portion would contact the top of the container body before the portions with the latches. This is because the latches would be used to pull the corners down tight after the free portions to the container lid were biased into the top of the container body 104.

In general it can be seen that embodiments of instant invention relates to pre-curving the main body of the container lid such that the portions that are not adjacent to a catch arrangement contact the top surface of the container body prior to the main body proximate the catches being biased against the top surface. This causes an improved axial seat of the bottom surface of the main body of the container lid onto the container body.

A further feature of embodiments of the present invention relate to the bowed side portions of the portion of the sealing flange 132 adjacent side portions 162, 164 (i.e. the portions extending between the front portion 144 and rear portion 156 between the corresponding corners 146, 158 and 148, 160). By having the sealing flange bowed radially outward, as the main body 130, and consequently sealing flange 132, flattens during the closing operation, the bowed side portions of sealing flange 132 will want to deform radially outward forcing them into increased engagement with the inner surface of the sides 123, 125 of annular sidewall 110 of the container body 104. By having the sealing flange 132 bowed radially outward, the construction of the sealing flange predetermines the direction of deformation for these portions of the sealing flange 132 during the closing operation.

Figure 13:
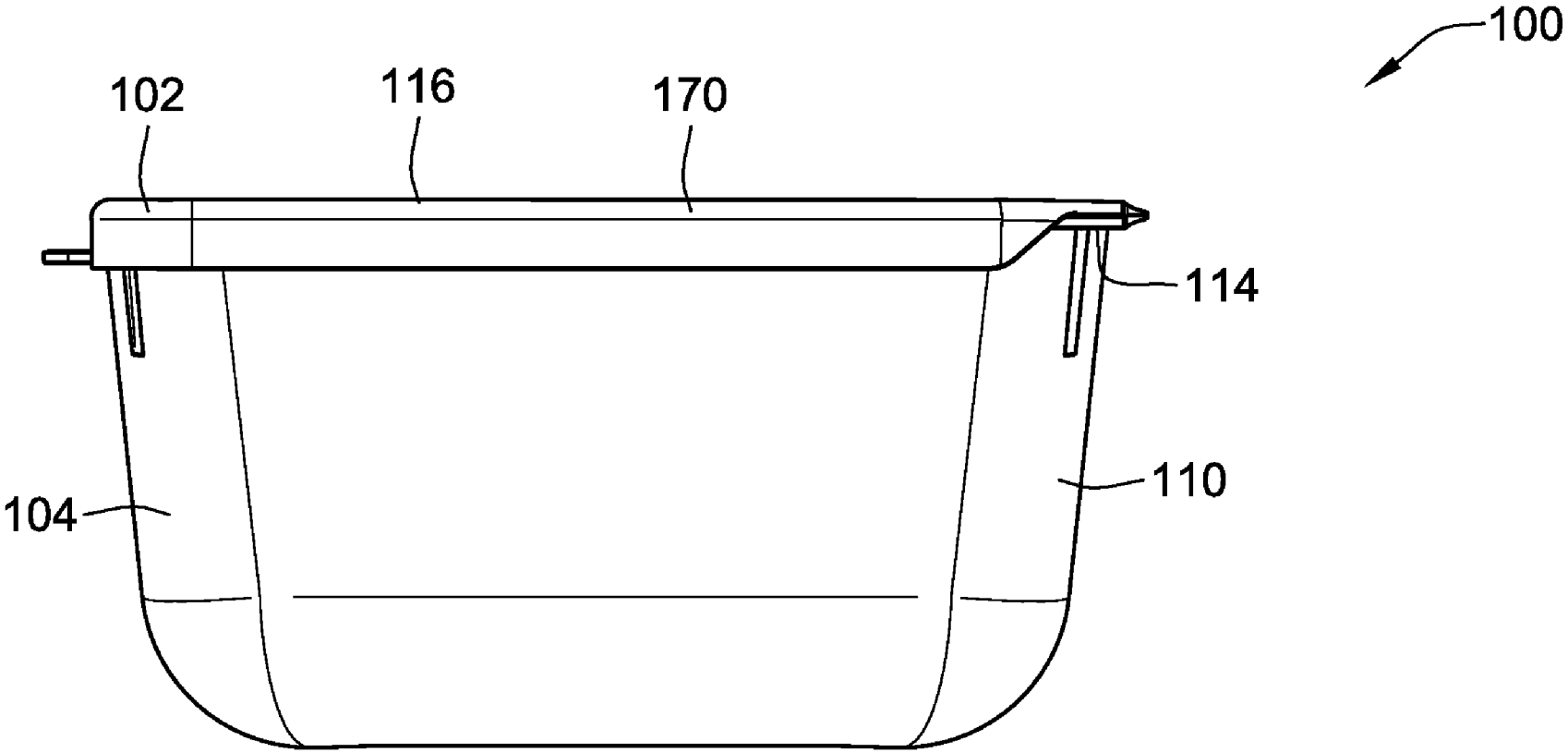
FIG. 13 is a side view illustration of the container of FIG. 1 in a closed orientation.
Figure 14:
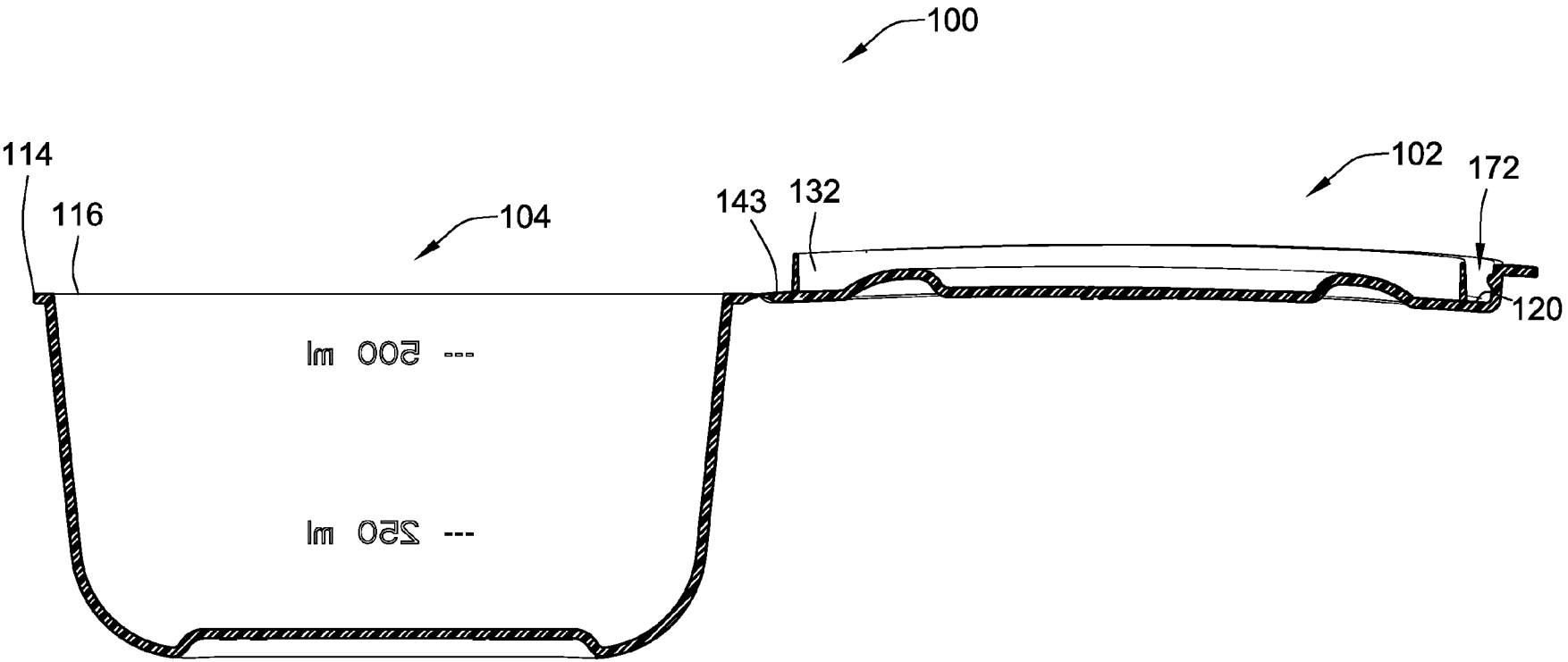
FIG. 14 is a side cross-sectional illustration of the container of FIG. 1 in an open orientation.

In one embodiment, as the container lid 102 transitions from the open position to the closed position, the center portions 180, 182 of the opposed sides (see FIGS. 4 and 13) are biased radially away from one another. In one embodiment, if the container lid 102 were transitioned to the open position without being installed into the annular wall 110 of the container body 104, the distance D measured at center points 180, 182 of sides 162, 164 would increase by between about approximately 0.001% and 0.01%. In one embodiment, the incremental increase in distance D is between about 0.005 and 0.020 inches. However depending on the length of the side portions 162, 164 the absolute amount of flexure radially outward will vary. Notably, this amount of deviation in distance D may vary depending on the size of the container and the and the angle $\alpha$ discussed above.

In one particular embodiment, all portions of the sealing flange are on the same side of or included in the reference plane 153.

The container lid 102 and container body 104 include stacking channels for promoting stackability of containers 100 when they are in the closed condition. Other embodiments may not include these features.

Turning now to FIGS. 15-24, a further embodiment of the container 100 is illustrated. In this embodiment, the container 100 incorporates at least one, and preferably, a plurality of projections in the form of detents 202 arranged along the skirt 170. The detents 202 provide for additional seal integrity between the container lid 102 and container body 104 (see FIG. 1) by resiliently engaging the radially extending top flange 114. Additionally, and as will be further detailed below, the detents 202 also allow for the container 102 to remain partially open in a generally controlled manner for venting and other purposes.

Figure 15:
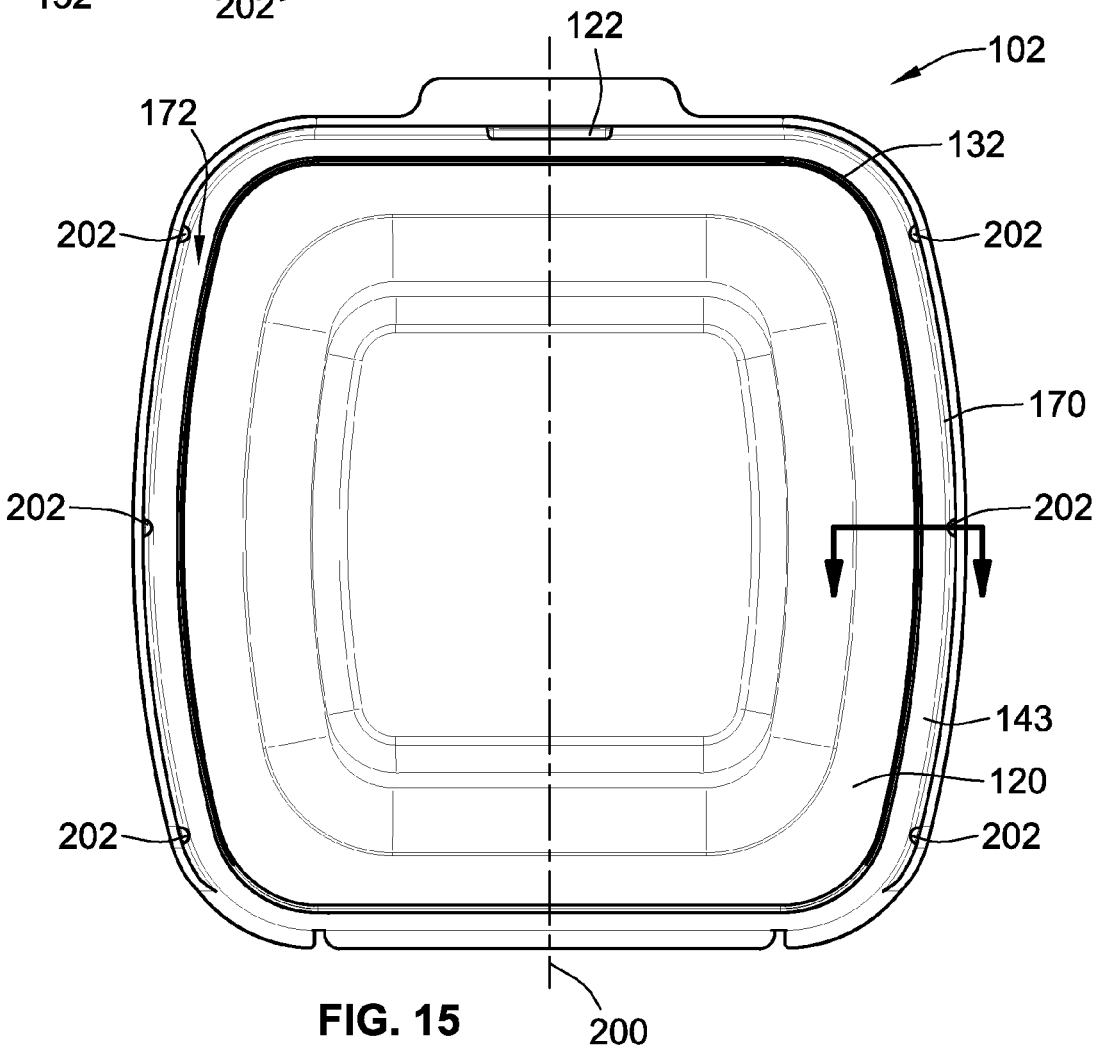
FIG. 15 is a bottom view of the container lid of FIG. 1 including at least one detent.

With reference to FIG. 15, the detents 202 are arranged symmetrically about center line 200. In the illustrated embodiment, there are six detents 202 present on the skirt 170. However, it is recognized that fewer or more detents 202 can be present. Additionally, the detents 202 can be arranged in an asymmetrical fashion about the skirt 170 in other embodiments.

Figure 16:
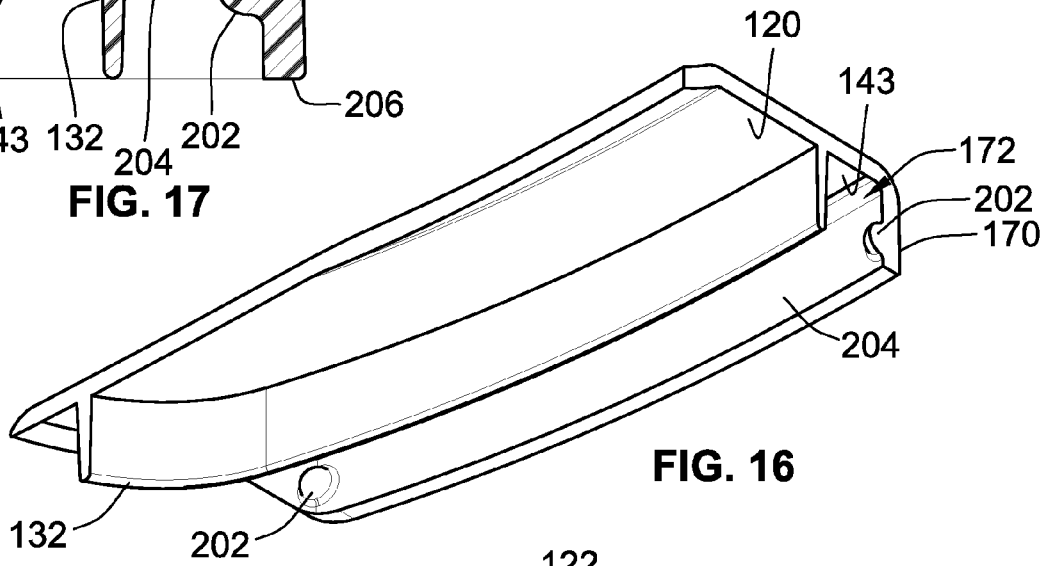
FIG. 16 is a partial perspective view of the at least one detent of FIG. 15.

Turning now to FIG. 16, the detents 202 project radially inward from an inner surface 204 of the skirt 170 into the receiving channel 172 formed between the skirt 170 and the sealing flange 132. As illustrated, the detents 202 are generally dome-shaped, however, other structures are contemplated, e.g. tabs, ramp-structures, etc.

Figure 17:
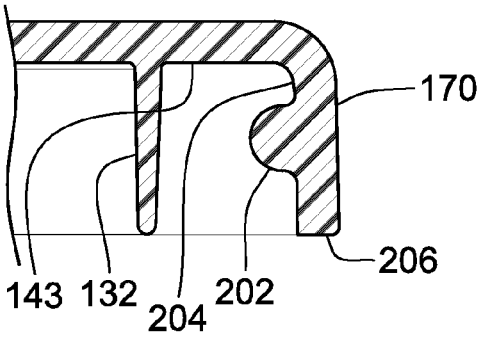
FIG. 17 is a partial cross section of the lid of FIG. 15.

With reference now to FIG. 17, each detent 202 is positioned along the inner surface 204 such that it is generally spaced apart from a distal end 206 of the skirt 170 as illustrated. However, it will be recognized that the detents 202 can be positioned at different locations along the inner surface 204 in other embodiments.

Figure 18:
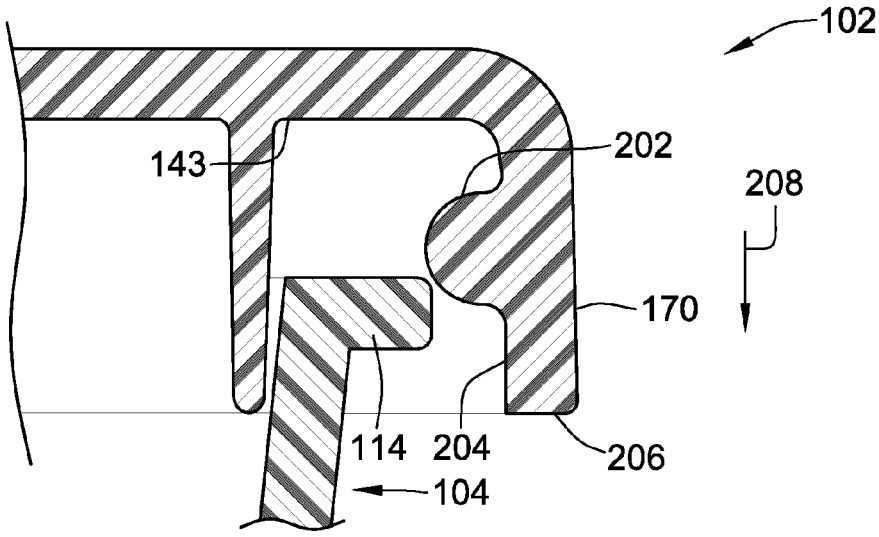
FIGS. 18-20 are partial cross sections of several positions of the lid of FIG. 15 relative to the container body.

Turning now to FIG. 18, when the detents 202 are positioned above the flange 114 as illustrated, the lid 102 can freely move relative to the container body 104. However, it is possible to selectively position certain ones of the plurality of detents 202 above the flange 114, and position certain other ones of the plurality of detents below the flange 114 to partially open the container 100. In such a configuration, the lid 102 will be partially constrained relative to the body 104.

Figure 19:
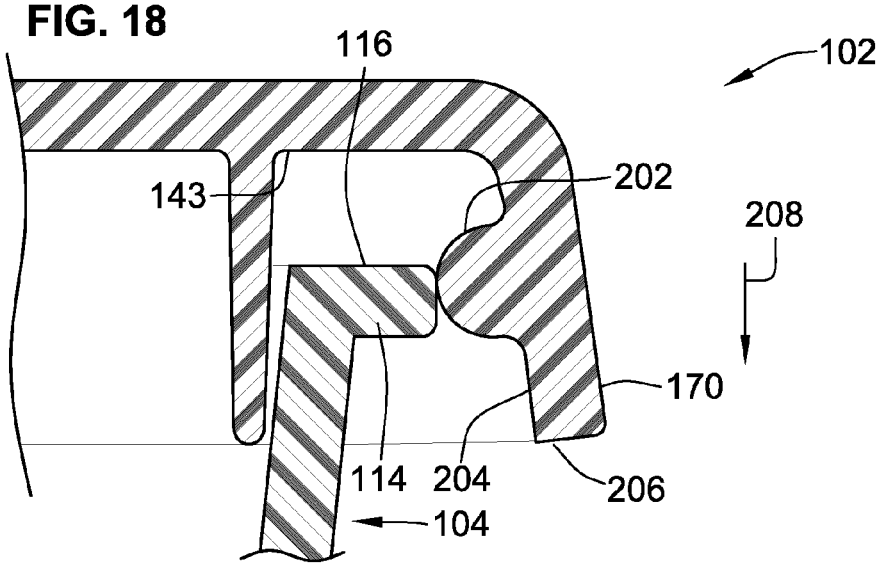
Figure 20:
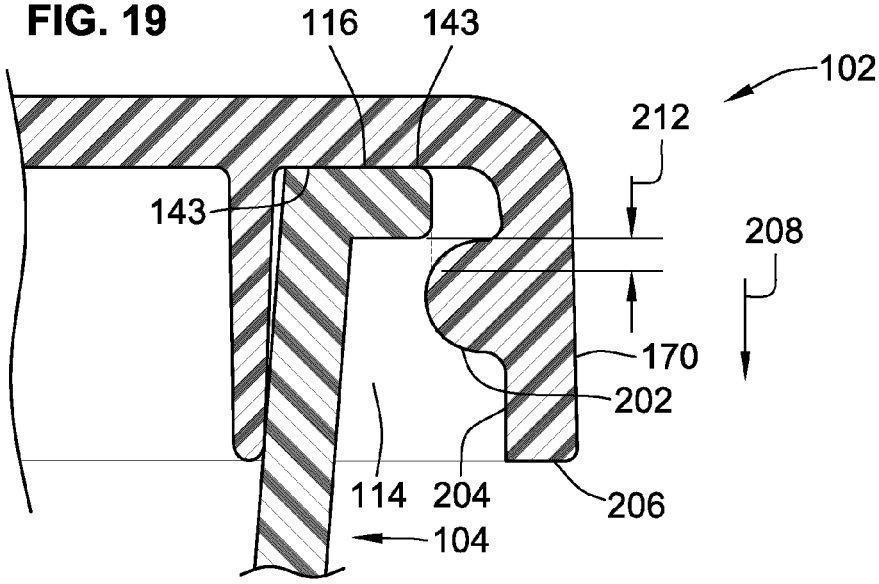

As the lid 102 moves in direction 208, the detents 202 positioned above the flange 114 will come into contact therewith. With reference to FIG. 19, once these detents 202 contact the flange, the skirt 170 will elastically flex radially away from the flange 114 to allow the lid 102, and particularly the detents 202, to move axially relative to the flange 114. With reference to FIG. 20, once the detents 202 move past the flange 114, the seat 143 will contact the top surface 116 of the flange 114 as illustrated, and the skirt 170 will elastically return to its original configuration. As illustrated in FIG. 20, when the detents 202 are positioned below the flange 114, there is a slight clearance gap 212 therebetween. It is recognized that in other embodiments, the clearance gap 212 can be larger, or omitted entirely such that the detents 202 rest against a bottom surface of the flange 114.

Further, when the detents 202 move below the flange, a tactile and audible response is provided in the form of a snapping noise. This response provides an indication that the detents 202 are positioned below the flange.

Figure 21:
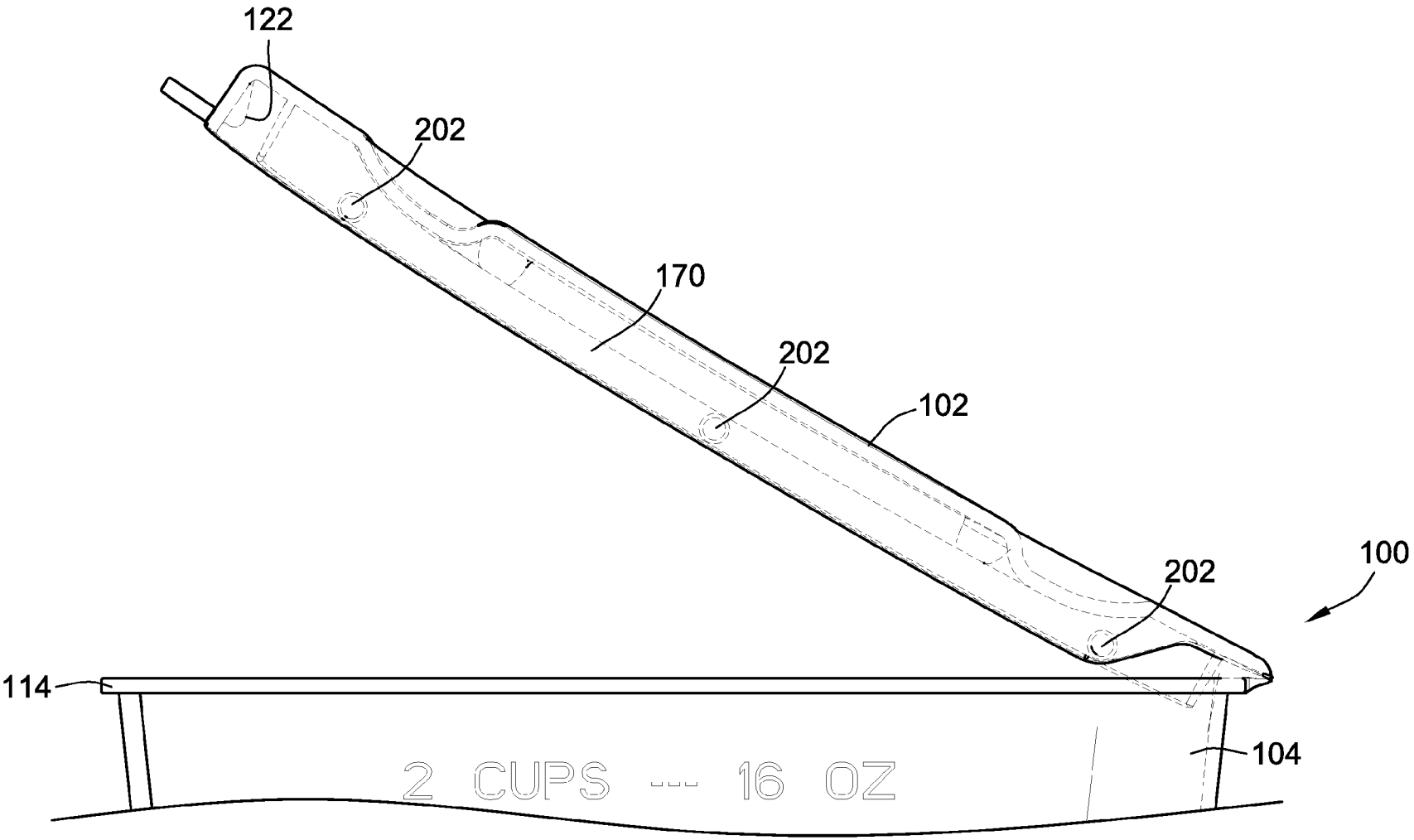
FIGS. 21-24 are partial side views of several positions of the lid of FIG. 15 relative to the container body.

FIGS. 21-24 illustrate various configurations of the lid 102 relative to the body 104. In FIG. 21, the container 100 is illustrated in an open position. By "open" it is meant that none of the detents 202 are positioned below the flange 114. In this configuration, the lid 102 is free to move relative to the body 104.

Figure 22:
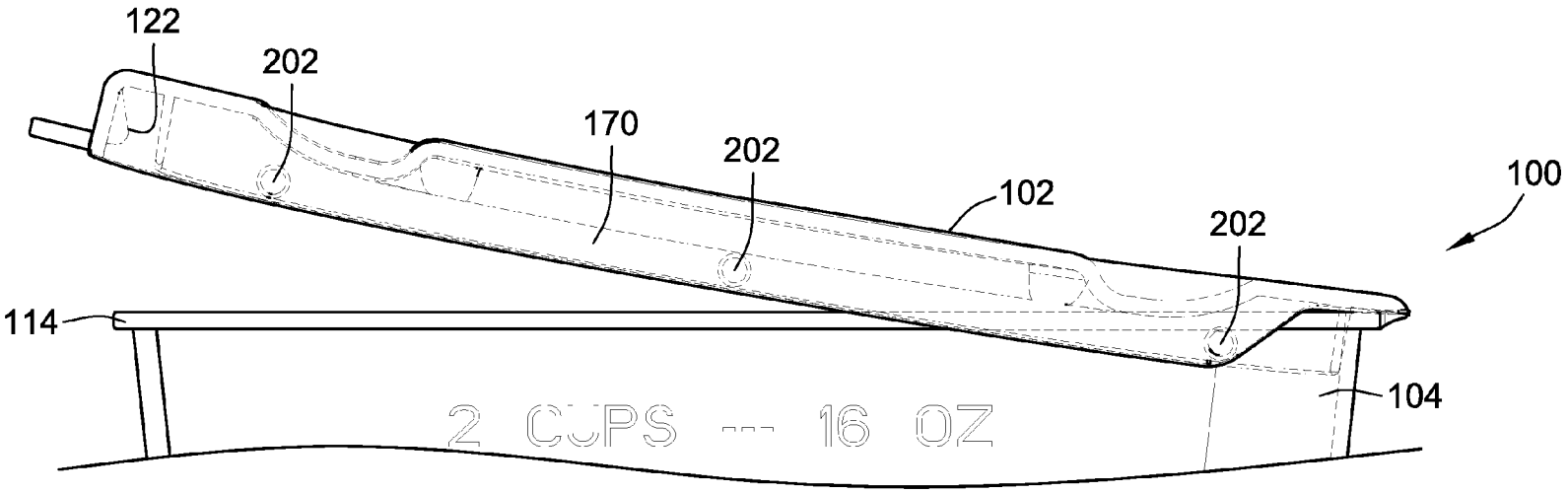
Figure 23:
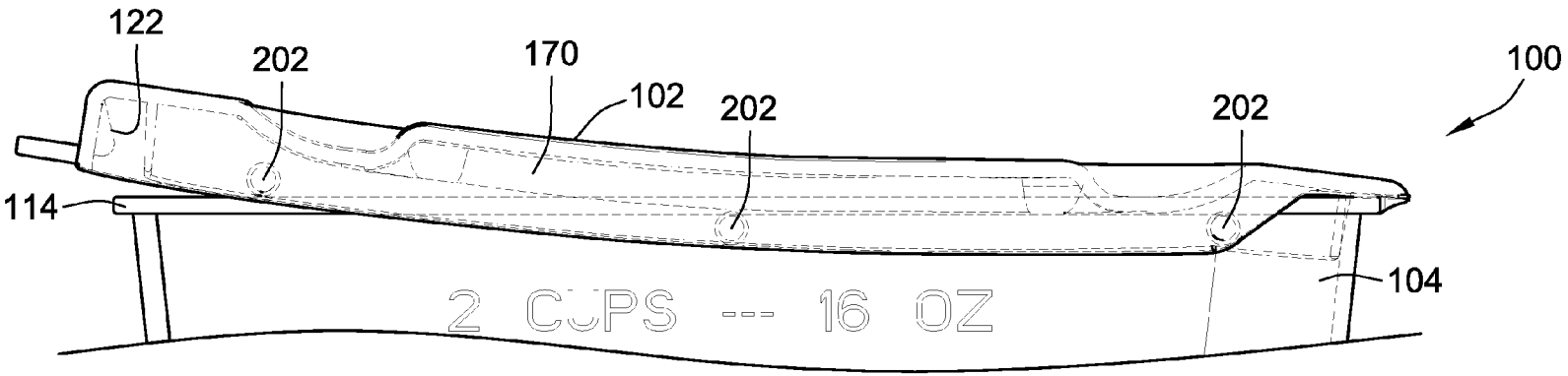

In FIGS. 22 and 23, the container 100 is illustrated in an intermediate position. By intermediate it is meant that at least one detent 202 is positioned below the flange 114. Due to the symmetrical arrangement of the detents 202 (see also FIG. 15), typically aligned pairs of detents 202 in opposed spaced relation to one another are positioned above or below the flange 114 simultaneously. However, it is possible to selectively position each detent 202 relative to the flange 114 independently of each other detent 202.

With particular reference to FIG. 23, only the detents 202 closest to the latch segment 122 remain positioned above the flange 114. This partially open configuration is ideal for the heating of food items within the container 100 that require venting for proper heating.

Figure 24:
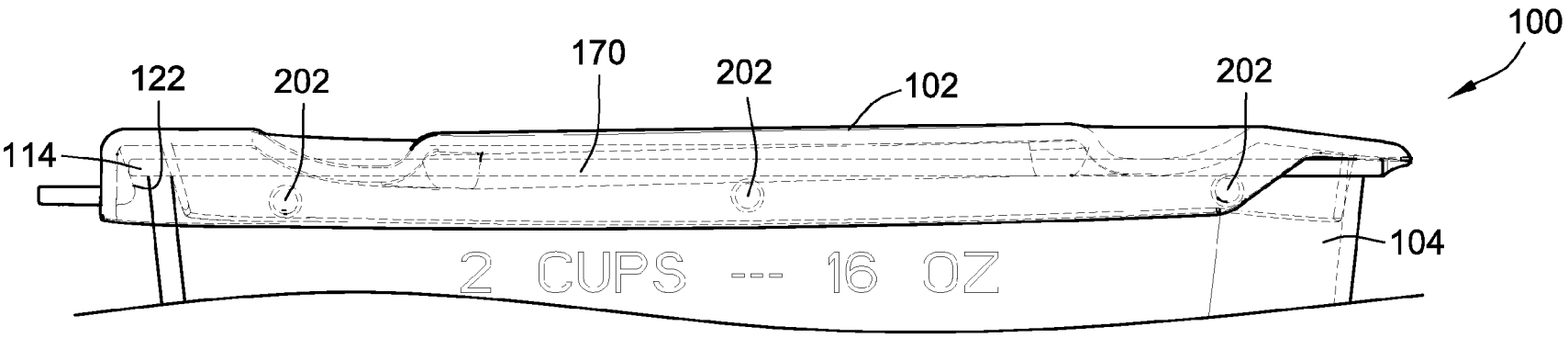

Turning now to FIG. 24, the container 100 is illustrated in a closed configuration. By "closed" it is meant that all of the detents 202 are positioned below the flange 114. In this configuration, the lid 102, and more particularly the sealing flange 132 (see FIG. 1) fully seals against the container body 104 as described above. The positioning of the detents 202 reduces the likelihood that the seal formed between the lid 102 and the body 104 will be inadvertently broken in the event the container 104 is dropped or otherwise subjected to an impact loading.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A plastic container, comprising:

a container body having a bottom wall, a pair of opposed side walls, a front wall and a back wall in opposed spaced relation to the front wall, the pair of opposed side walls, front wall, and back wall each depending upwardly from the bottom wall to define a storage area and extending to a continuous and uninterrupted outwardly projecting flange defining an uppermost extent of the storage area;

a lid comprising a top wall, a front wall, and a pair of opposed side walls, the front wall and opposed side walls depending downwardly from the top wall, wherein a portion of an edge of the top wall is coupled to the container body by a living hinge such that the lid is movable between an open position wherein the storage area is accessible, and a closed position, wherein the storage area is inaccessible;

a sealing flange inwardly offset from the front wall and pair of side walls of the lid and depending downwardly from the top wall of the lid, the sealing flange comprising a tapered wall with a smooth uninterrupted sealing surface, the sealing surface engaging each of the opposed side walls, front wall, and back wall of the container body in the closed position;

a catch projecting inwardly from the front wall of the lid and arranged to engage the outwardly projecting flange of the container body;

a plurality of detents arranged in an opposed space relationship on the opposed side walls of the lid and configured to resiliently engage the outwardly projecting flange of the container body when transitioning the lid between the open and the closed positions.

2. The plastic container of claim 1, wherein the plurality of detents are symmetrically arranged about a center axis of the container lid in an opposed spaced relation.

3. The plastic container of claim 1, wherein the plurality of detents are regularly spaced in number along the side walls.

4. The plastic container of claim 3, wherein the detents positioned on one side wall are aligned with the detents positioned on the opposed side wall.

5. The plastic container of claim 1, wherein the sealing flange includes a base which connects the sealing flange to the bottom surface and extends downwardly to a distal end, wherein the sealing surface is outwardly directed and is defined between the base and the distal end, wherein the sealing surface is smooth and free of any undercuts.

6. The plastic container of claim 5, wherein the sealing flange does not axially engage the container body to inhibit transitioning the lid between the closed position to the open position.

7. The plastic container of claim 1, wherein the plurality of detents are dome shaped.

8. The plastic container of claim 1, wherein the plurality of detents are only on the opposed side walls of the lid and not on the front wall of the lid.

9. The plastic container of claim 8, wherein the catch is in contact with the outwardly projecting flange of the container body in the closed position, and the plurality of detents are not in contact with the outwardly projecting flange of the container body in the closed position.

* * * * *